United States Patent [19]

Alberto

[11] Patent Number: 4,672,834

[45] Date of Patent: Jun. 16, 1987

[54] METHOD FOR MAKING EXTENDED HEAT TRANSFER SURFACES AND A TOOL FOR PUTTING SAID METHOD INTO PRACTICE

[76] Inventor: Scoti Alberto, 141, Via di Petigliolo, Greve (Florence), Italy

[21] Appl. No.: 777,565

[22] Filed: Sep. 18, 1985

Related U.S. Application Data

[63] Continuation of Ser. No. 546,948, Oct. 31, 1983, abandoned.

[30] Foreign Application Priority Data

Nov. 4, 1982 [IT] Italy ..... 9531 A/82

[51] Int. Cl.[4] ..... B21D 53/04; B21D 53/06

[52] U.S. Cl. ..... 72/325; 72/71; 29/157.3 A; 29/157.3 R

[58] Field of Search ..... 72/325, 324, 464, 71, 72/70; 29/157.3 R, 157.3 A, 157.3 AH, 33 G, 727; 76/21, 14, 19

[56] References Cited

U.S. PATENT DOCUMENTS

| | | | |
|---|---|---|---|
| 634,469 | 10/1899 | Majert | 29/157.3 A |
| 2,162,693 | 6/1939 | Berg et al. | 29/157.3 AH |
| 3,753,364 | 8/1973 | Runyan et al. | 29/157.3 R |
| 3,791,003 | 2/1974 | Pasternak | 72/71 |
| 3,886,639 | 6/1975 | Pasternak | 72/325 |
| 4,100,784 | 7/1978 | Thomas | 29/157.3 AH |

FOREIGN PATENT DOCUMENTS

| | | | |
|---|---|---|---|
| 33614 | 5/1905 | Switzerland | 72/21 |

*Primary Examiner*—Daniel C. Crane
*Attorney, Agent, or Firm*—Browdy & Neimark

[57] ABSTRACT

A method for making integral fins on plane or curved heat transfer surfaces wherein a fin is obtained by making an inclined cut on the surface itself to provide a thin strip or layer of metal connected to the surface along one edge, raising said layer and bending it around said connecting edge to a substantially perpendicular relation with respect to said surface. For putting said method into practice a finning tool is provided wherein the cutting angle of its cutting edge increases from a nose, the length of cutting edge is greater than the one of the fin to be formed and the cutting edge itself is inclined so as to obtain a cutting line inclined with respect to the profile of the surface.

7 Claims, 10 Drawing Figures

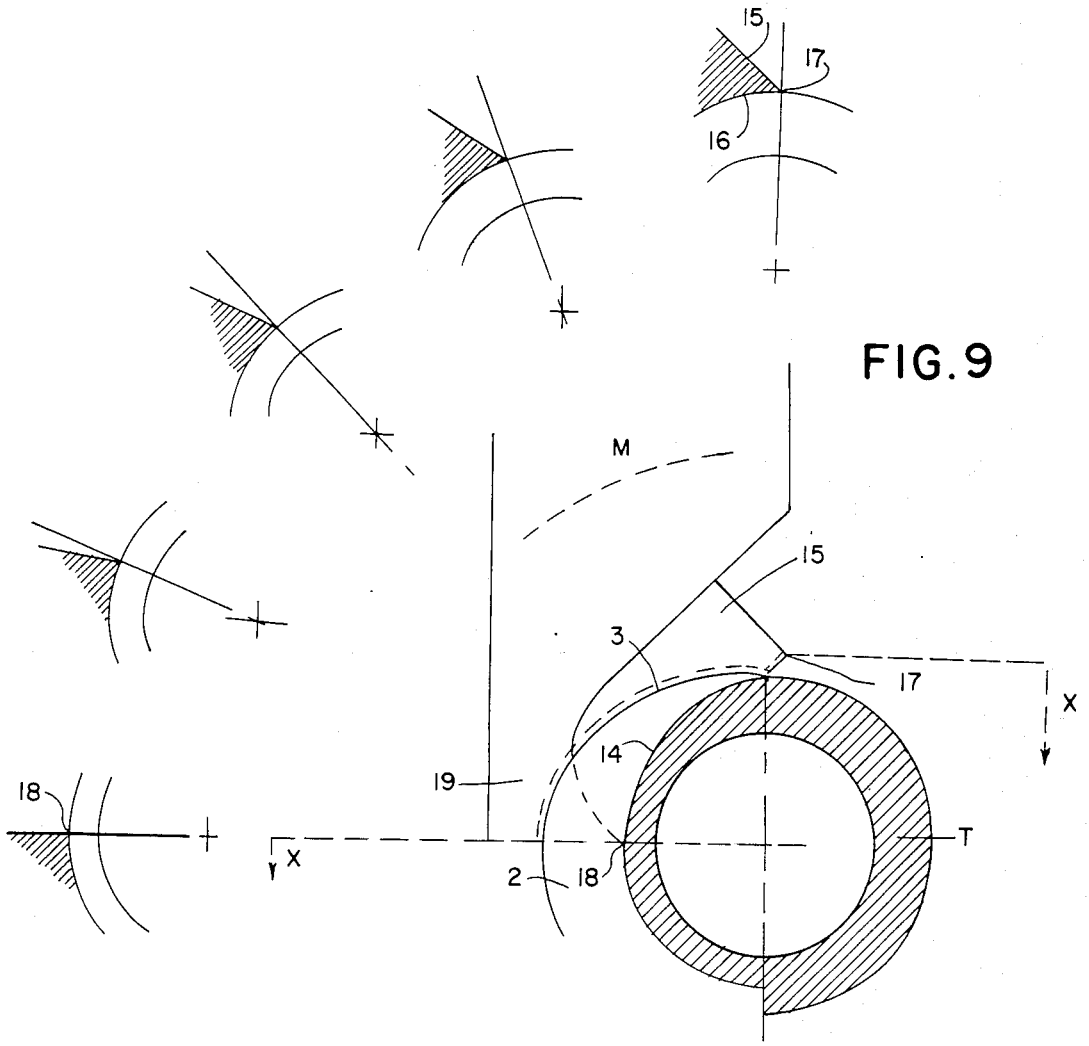
FIG. 9
FIG. 10
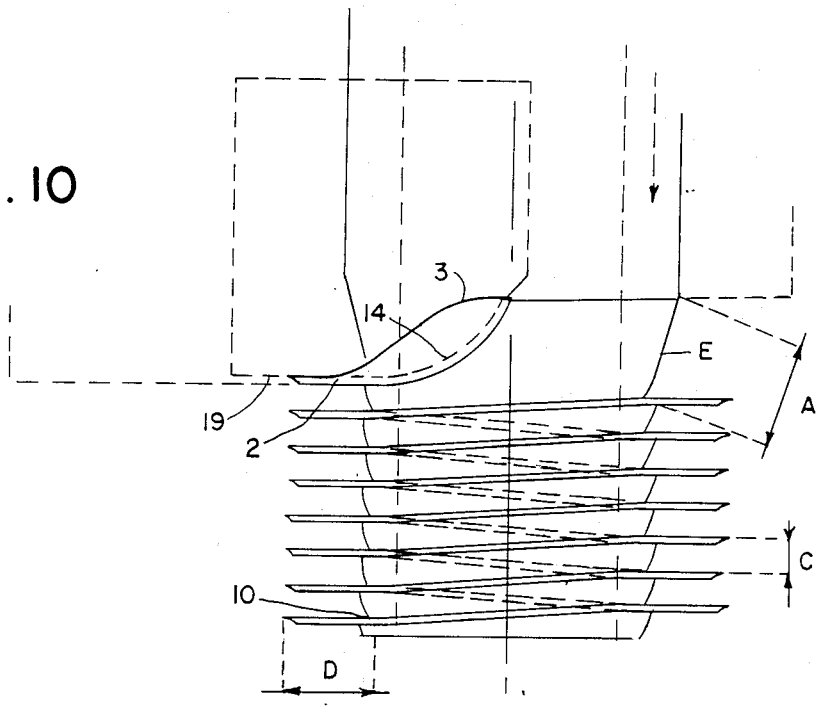

METHOD FOR MAKING EXTENDED HEAT TRANSFER SURFACES AND A TOOL FOR PUTTING SAID METHOD INTO PRACTICE

This application is a continuation of application Ser. No. 546,948, filed 10/31/83, now abandoned.

The present invention relates to the field of the extended surfaces commonly used for heat transfer operations and in particular refers to a method for making integral fins (i.e. fins integrally shaped from the surface metal itself) on plane or curved heat transfer surfaces.

The invention also relates to a tool for making integral fins on said surfaces according to this method.

Hitherto various processes have been used for making fins of extended surfaces differing from one another according to the type of fins and material used (steel, copper, aluminium, etc.). Helical fins on pipes and tubes are transverse fins which may be obtained in a variety of ways such as by grooving and peening, expanding the tube metal itself to form the fins or welding metal ribbon to the tube continuously. Disc-type fins are usually welded to the tube or shrunken to it. In other cases a pack of spaced metal sheets is used, provided with a plurality of holes into which small pipes are engaged.

The above described methods generally require complicated processing. Furthermore, when finning is obtained by expanding the pipe metal (this method is especially used when the material involved is copper or aluminium), the extent of finned surface that can be obtained is very low; consequently a large amount of finned elements have to be provided for, in order to have the desired heat transfer, with increased costs, weight, and overall dimensions of the equipment. When packs of metal sheets are employed as fins, other problems are encountered such as construction and mounting difficulties, defective contact between the surface of the pipes and the wall of the holes in the metal sheets, as well as considerable costs and weight.

It is an object of the present invention to provide a method for making integral fins on heat exchange surfaces by a simple, inexpensive processing.

Another object of the invention is to provide a method for making integrally finned surfaces with a heat exchange area per unit surface greater than the one obtainable by the known methods.

A further object of the invention is to provide a tool, suitable for being used with common machine tool, for making integral fins on plane or curved heat transfer surfaces by operating according to said method.

According to the invention, integral fins on plane or curved heat exchange surfaces are obtained by making inclined cuts on the surface itself to provide thin strips or layers of metal connected to the surface along one edge and bending them around the connection edge to a substantially perpendicular relation with respect to said surface.

The invention is described in detail below with reference to the attached drawings, in which:

FIG. 9 is a front view of a tubular workpiece and of the tool cutting, raising and bending a fin, also showing how the cutting angle varies from the nose 17 to the non cutting edge 18.

FIG. 10 is a side elevational view of the tubular workpiece of FIG. 9 made along the crest of the fin in formation (line X—X).

Figure 1:
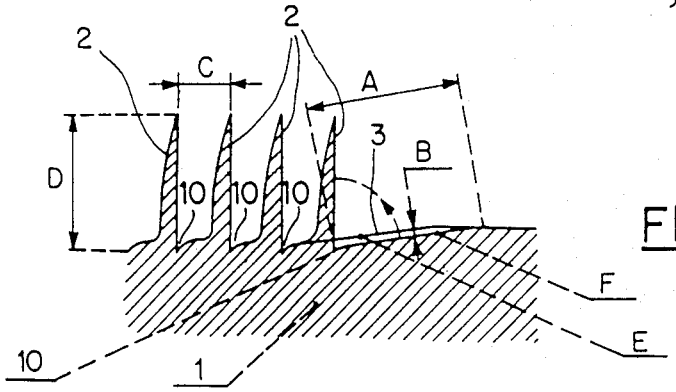
FIG. 1 illustrates the way of making integral fins in accordance to the method of the present invention.

In order to illustrate how integral fins can be made according to the invention, reference is made to FIG. 1 where a schematic cross section, for instance of a plane surface 1, is shown. Fins 2 have already been produced, while fin 3 has still to be shaped. E indicates the cutting line from which the lastly shaped fin has been detached and F the cutting line of the new fin 3. The cutting lines are inclined with respect to the profile of surface 1 so that the strip or layer of metal, which is obtained on cutting, is integral to the surface along one edge or fin root. When the metal layer has been cut, it is bent around its connection edge or fin root by forcing against the layer side that has been detached from the surface 1 along cutting line F.

Due to the fact that cutting line F is inclined with respect to the profile of surface 1, width A and thickness B of fins 2 and 3 are independent of fin pitch C. Therefore, a large number of fins per unit surface and an increased overall heat transfer surface can be provided. Fins obtained according to said method are integral with the surface thus resulting in a better heat transfer efficiency than when fins are attached to the surface. This method can be used to make fins of any type of metal, but it is particularly advantageous when heat exchange surfaces to be finned are made of copper or aluminium.

According to the invention there is furthermore provided a tool for making fins in accordance to the above described method, in particular suitable of being machine operated and being mounted on well known machine-tools.

The tool according to the invention is characterized by the fact that its cutting edge has a cutting angle that increases from its nose and a length of said edge greater than the width of the metal layer to be cut, said cutting edge being inclined with respect to a plane tangent to the surface to be finned, so as to obtain a cutting line inclined with respect to the profile of said surface. In particular, the head of the tool will be so shaped to work on plane or curved surfaces for instance pipe surfaces; this result will be accomplished by suitably shaping the main flank of it, i.e. the one facing towards the surface to be worked.

Figure 2:
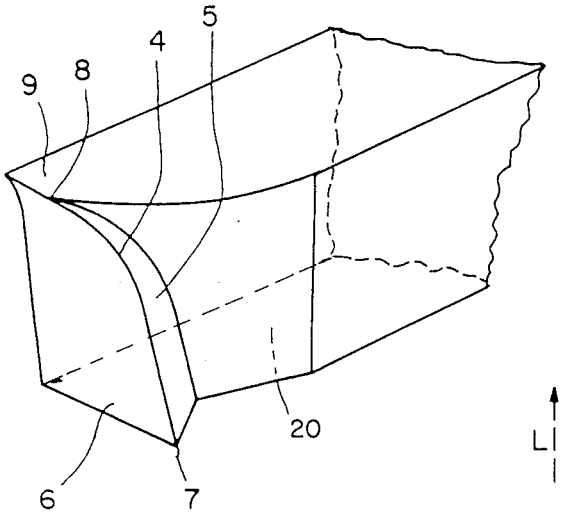
FIG. 2 is a perspective view of a tool for making integral fins on plane surfaces according to said method.
Figure 3:
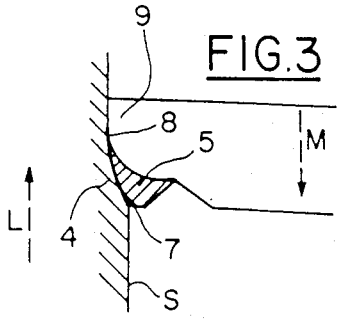
FIG. 3 is a side view of the tool of FIG. 2.

With reference to FIG. 2, a tool suitable for making parallel, integral fins, on plane surfaces is shown. The cutting edge, the face and the main flank of the tool are indicated at 4, 5 and 6 respectively. Cutting edge 4 extends curvedly smoothly, i.e., without discontinuitly and diagonally with respect to a front view of the tool. Main flank 6, which defines cutting edge 4 with face 5, is inclined, with respect to a normal cross section of tool head, of an angle equal to the inclination of cutting lines E or F. The cutting angle of cutting edge 4 increases from its nose 7, where it is 30° and 60° (in particular 45°), to point 8 of cutting edge 4, where it reaches 90° approximately thus losing any cutting capability (i.e., where face 5 merges with side flank 9, perpendicular to main flank 6). From point 8 cutting edge 4 extends with the same cutting angle along the edge defined by main flank 6 and side flank 9. As shown in FIG. 3, cutting edge 4, at nose 7, also extends for a portion of its length at about a 90° angle with respect to the direction of travel during the finning operation and then smoothly curves around until, at point 8, a portion of cutting edge 4 extends parallel to the direction of travel. Thus, the metal layer cut by cutting edge 4 is raised by face 5, and bent up to a position perpendicular to the surface by side flank 9 which forces against its side.

In order to have the fins firmly rooted to the surface and to further increase heat transfer surface, the edge defined by main flank 6 and side flank 9 is sharp so as to produce a small groove 10 at the root of each fin (see FIG. 1).

As shown in FIG. 3, the above described tool works approximately in a perpendicular direction with respect to the plane surface 1 to be finned (that in turn is perpendicular to the plane of drawings), therefore cutting edge 4 is inclined with respect to it to produce inclined cutting lines E or F. Arrows M and L show the direction of cutting motion of the tool or, alternatively, of the piece. In the present case, in which parallel fins are to be made, feed or advancing motion is discontinuous.

Figure 4:
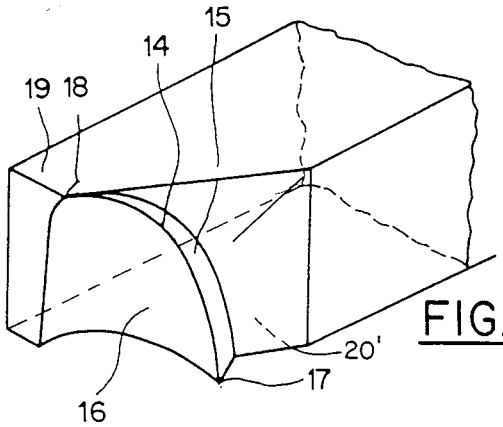
FIG. 4 is a perspective view of a tool for making integral fins on curved, tubular surfaces according to said method.

Referring now to FIG. 4, a tool suitable for making parallel or helical, integral fins on surfaces of pipes and tubes is shown. The cutting edge, the face and the main flank of the tool are indicated at 14, 15 and 16 respectively. The shape and extent of cutting edge 14 is analogous to the one previously described with respect to the finning tool for plane surfaces. Clearly main flank 16, being required to meet a cylindrical surface and at the same time to define with face 15 and inclined cutting edge 14, is shaped as a portion of conic surface. Cutting angle likewise increases from its nose 17 (at the intersection of main flank 16 and side flank 20'), where it is comprised between 30° and 60° (in particular 45°) up to point 18 of cutting edge 14, where it reaches 90° approximately and the tool loses any cutting capability. The metal layer cut by cutting edge 14 and raised by face 15 is then bent by side flank 19 of the tool up to a position in which it is perpendicular to the axis of the tube. Point 18 is sharpened by reducing the bending radius of the adjacent portion of main flank 16, to produce a groove at the root of fins, as previously described.

Figure 5:
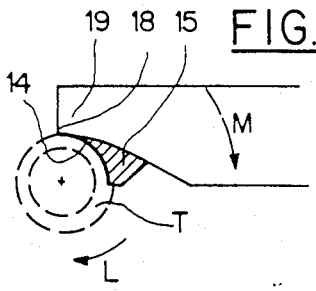
FIG. 5 is a side view of the tool of FIG. 4.

As shown in FIG. 5, in the use the finning tool for curved surfaces is set with respect to the tube T in such a way to face a portion of lateral surface of the tube itself with main flank 16, the tube being perpendicular to the plane of drawings; in this way, due to the conic shape of flank 16, cutting edge 14 is inclined with respect to the profile of tube T so as to produce an inclined cut on its surface. In the present case the advance or feed motion can be continuous, when helical fins have to be formed, or discontinuous for parallel fins, while cutting motion can be imparted to the tool (arrow M) or to tube T (arrow L) indifferently.

The orientation of the head of the tool according to the invention with respect to the shank of the tool itself may be different from the one shown in FIGS. 2 to 5, depending on the type of machine-tool for which the tool itself is designed to be mounted. Nevertheless the characterizing shape of cutting edge 4, 14 will remain unchanged.

Figure 8:
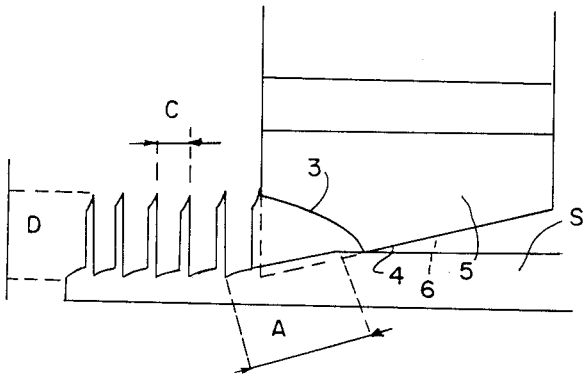
FIG. 8 is another side elevational view according to the arrow F of FIG. 9.
Figure 6:
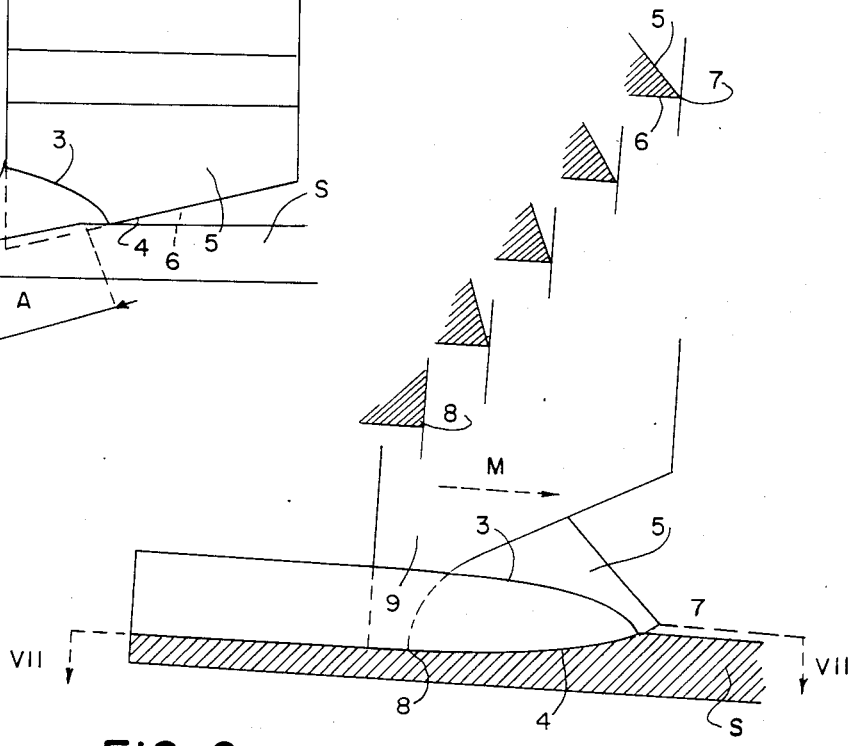
FIG. 6 is a side elevational view of the tool in operative engagement with a fin being cut, raised and bent, also showing how the cutting angle varies from the nose 7 to the non-cutting edge 8.
Figure 7:
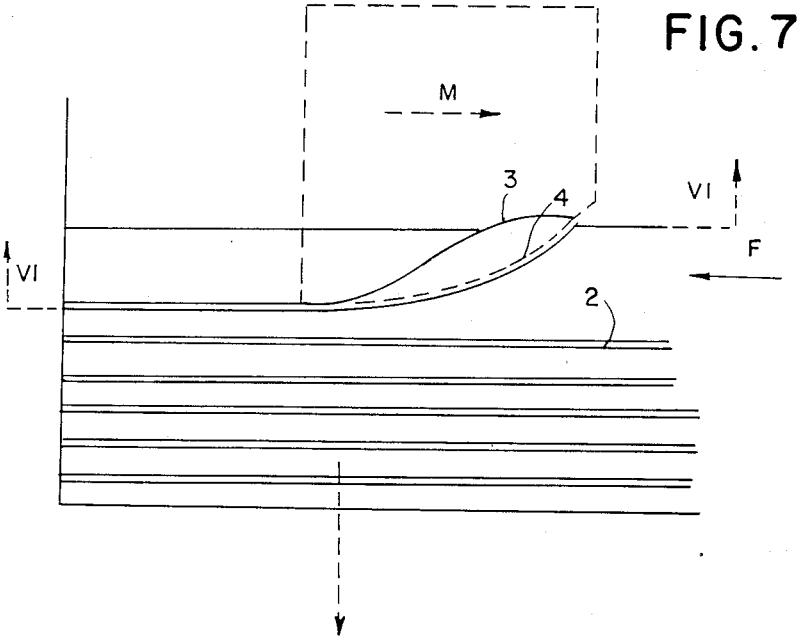
FIG. 7 is a plan sectional view of the workpiece of FIG. 8 made along the cutting edge of the tool (line VII—VII).

The working of the tool of the present invention is more fully shown in FIGS. 6–8, which show the interaction of the tools of FIGS. 1 and 2 on a surface.

I claim:

1. A tool for making integral fins on plane or curved heat transfer surfaces comprising:

a face, a main flank, an edge thereof forming an intersection with an edge of said face, a pair of opposing side flanks intersected by said main flank, a cutting edge defined by the intersection of said face and said main flank, said cutting edge having a nose portion defined as the intersection of said main flank with one of said side flanks, said cutting edge being curvilinear and extending substantially diagonally relative to said main flank from said nose portion to said other side flank, said face being inclined with respect to said main flank, the inclination of which defines a cutting angle, increasing from said nose portion to said other side flank, where said angle is 90° and said face merges into said other side flank without discontinuities at the intersection of said main flank and the other side flank, said cutting edge having further a length greater than the height of the fin to be formed.

2. The tool of claim 1, wherein said cutting angle is 30° at said nose portion.

3. A tool according to claim 1, wherein the main flank thereof is substantially plane.

4. A tool according to claim 3, wherein said main flank and said other side flank define a sharp edge so as to produce a small groove at the root of said fin.

5. A tool according to claim 1, wherein the main flank thereof is a portion of conic surface.

6. A tool according to claim 5, wherein a sharp point is provided at a point said cutting edge joins said other side flank of said fin.

7. A method of making integral fins on a plane or curved heat transfer surface comprising the steps of:

providing a tool including a face, a main flank, an edge thereof intersecting with an edge of said face, a pair of opposing side flanks forming an intersection with said main flank, a cutting edge defined by the intersection of said face and said main flank, said cutting edge having a nose portion defined as the intersection of said main flank with one of said side flanks, said cutting edge being curvilinear and extending substantially diagonally relative to said main flank from said nose portion to said other side flank, said face being inclined with respect to said main flank, the inclination of which defines a cutting angle, increasing from said nose portion to said other side flank, where said angle is 90° and said face merges into said other side flank without discontinuities, at the intersection of said main flank and the other side flank, said cutting edge having further a length greater than the height of the fin to be formed;

contacting said main flank against said heat transfer surface so that said cutting edge is inclined at a small angle with respect to a plane tangent to said heat transfer surface;

providing relative movement, parallel to said heat transfer surface, between said tool and said heat transfer surface in a relative direction of movement of said tool such that said inclined face is inclined away from said relative direction of movement of said tool and said nose portion extends at about a 90° angle with respect to a line defined by said relative direction of movement of said tool, whereby, said nose portion of said cutting edge, moving in said direction of relative movement of said tool, cuts a thin layer from said surface of said heat transfer surface and said layer then follows along said cutting edge until said layer is forced by said other side flank to an orientation substantially perpendicular to said relative direction of movement of said tool, thereby forming said integral fin.

* * * * *

UNITED STATES PATENT AND TRADEMARK OFFICE

CERTIFICATE OF CORRECTION

PATENT NO. : 4,672,834

DATED : June 16, 1987

INVENTOR(S) : Alberto SCOTI

It is certified that error appears in the above—identified patent and that said Letters Patent is hereby corrected as shown below:

Correct the name of the inventor as follows:

[76] Inventor: Alberto Scoti, 141 Via di Petigliolo, Greve (Florence), Italy

Signed and Sealed this

Twenty-seventh Day of October, 1987

*Attest:*

DONALD J. QUIGG

*Attesting Officer*

*Commissioner of Patents and Trademarks*